US006354475B1

(12) United States Patent
Grace et al.

(10) Patent No.: US 6,354,475 B1
(45) Date of Patent: Mar. 12, 2002

(54) INFANT CARRIER

(76) Inventors: Kathleen J. Grace, 5739 Loma Verde; Anne M. Fonte, 16432 La Gracia, both of Rancho Santa Fe, CA (US) 92067

( * ) Notice: Subject to any disclaimer, the term of this patent is extended or adjusted under 35 U.S.C. 154(b) by 0 days.

(21) Appl. No.: 09/611,466

(22) Filed: Jul. 7, 2000

(51) Int. Cl.[7] ..... A61G 1/00

(52) U.S. Cl. ..... 224/158; 224/159; 224/160; 224/64

(58) Field of Search ..... 224/158, 159, 224/160, 625, 611; 297/183.1, 183.2; 4/572.1; D6/390, 333; 220/261

(56) References Cited

U.S. PATENT DOCUMENTS 554,412 A * 2/1896 Choate ..... 224/611
730,325 A * 6/1903 Wilson ..... 224/611
4,717,056 A 1/1988 Carmichael
4,958,887 A 9/1990 Meeker
4,971,343 A 11/1990 Wood
5,071,047 A 12/1991 Cordisco
D357,800 S 5/1995 Roan

* cited by examiner

*Primary Examiner*—Gregory M. Vidovich
*Assistant Examiner*—Maerena W Brevard
(74) *Attorney, Agent, or Firm*—Nydegger & Associates

(57) ABSTRACT

An ergonomically designed infant carrier for holding an infant while walking includes a container and a handle. The container includes an enclosing sidewall attached to a bottom wall to establish a compartment. Importantly, the sidewall is formed with two indentations that extend into the compartment. The indentations allow the carrier to fit snugly against the person's hip or leg during walking. The container is further formed with two handle attachment points. Each handle attachment point is located between the pair of indentations. In this configuration, when the handle is attached to the container, the straight section of the handle is oriented parallel with the sides of the container that are formed with indentations.

18 Claims, 3 Drawing Sheets

INFANT CARRIER

FIELD OF THE INVENTION

The present invention pertains generally to devices that are useful for carrying articles. More particularly, the present invention pertains to a device that can be used as an infant carrier. The present invention is particularly, but not exclusively, useful for an ergonomically enhanced infant carrier that prevents injuries and facilitates the lifting and carrying of an infant (or article), by allowing the person moving the carrier to maintain a proper anatomical alignment.

BACKGROUND OF THE INVENTION

Infant carriers are a popular way to transport young children. Heretofore, infant carriers have been made available with standard attachments that allow the infant carrier to be attached to strollers, car seats or shopping carts. Still, parents often must pick up and move the infant carrier between such devices, sometimes over long distances. Due to the size and weight of infants, as well as the requirements for compliance with health and safety regulations, presently available carriers are often bulky and hard to carry. Additionally, parents are often required to carry a plethora of infant accessories such as diaper bags and bottles, when transporting an infant. Thus, the typical parent is lucky to have one hand free to hold the infant carrier while walking into a store or out to the car.

Webster defines ergonomics as the science that seeks to adapt work or working conditions to the worker. To this end, a large amount of time has been spent by scientists studying the effects of improper working conditions on workers. This research has shown that improper work methods can cause repetitive stress injuries such as carpal tunnel syndrome and most importantly, lower back injuries. Further, improper work methods can cause workers to tire prematurely, leaving them vulnerable to work related injuries.

Heretofore, infant carriers that are capable of attaching to car seats, strollers and shopping carts have generally been composed of a two-part construction including a container and a handle. To pick up and walk with the infant carrier, the first step is to bend at the knees and waist, reach down and grab the handle with one hand. When this is done, the arm is generally kept relatively straight, but is angled away from the body. Next, the carrier is raised above the ground by straightening the knees or torso. At this point, the arm is still straight, and still angled away from the body. Unfortunately, standard carriers typically have straight sides that require the arm of the person transporting the carrier to be angled away from the body during the lifting a carrying process. One consequence of this is an anatomical misalignment that results in additional stress on the back, shoulder, hips, waist and arm. In extreme cases, the whole upper body may become twisted and contorted. Further, for carriers with straight sides, the weight of the carrier is centered significantly away from the body, requiring much more strength to lift and hold the carrier, which can result in muscle fatigue, strain and injury. Also, the configuration of standard carriers does not allow the carrier to rest comfortably against the body and to move with the body as the person walks.

In light of the above, it is an object of the present invention to provide an infant carrier that is easy to lift and hold while walking. It is another object of the present invention to provide an infant carrier that remains substantially still against the body while walking with the carrier. Still another object of the present invention is to provide an infant carrier which allows the body of the person moving the carrier to maintain a proper anatomical alignment while lifting and transporting the infant carrier. Yet another object of the present invention is to provide an infant carrier that allows the weight of the carrier and infant to be positioned closer to the body during lifting and carrying. Yet another object of the present invention is to provide an infant carrier which is relatively easy to manufacture and simple to use, as well as being comparatively cost effective.

SUMMARY OF THE PREFERRED EMBODIMENTS

An ergonomically designed infant carrier for lifting and holding an infant includes a container and a handle. For the present invention, the container includes a bottom wall and an enclosing sidewall that has a first edge and a second edge. The second edge of the enclosing sidewall is attached to the periphery of the bottom wall to define or establish a compartment. In this configuration, the first edge surrounds an opening for the compartment. Further, the first edge can be formed with a lip that extends away from the opening.

Relative to the compartment, the sidewall has an inner surface that faces toward the compartment and an outer surface that faces away from the compartment. Importantly, the sidewall is formed with two indentations that extend from outside the infant carrier into the compartment. Accordingly, each indentation creates a concave curvature on the outer surface of the sidewall and a convex curvature on the inner surface of the sidewall. In the preferred embodiment, the two indentations are positioned at diametrically opposed locations on the sidewall. Further, each indentation is positioned between two diametrically opposed, intermediate sections of sidewall which respectively identify the head and foot of the infant carrier. Also, each intermediate section of sidewall has a convex curvature on the outer surface of the sidewall. In this configuration, each intermediate section of the sidewall is positioned between two indentations. Consequently, the enclosing sidewall includes two indentations and two intermediate sections.

For the present invention, the container is further formed with two attachment points that are positioned on the outer surface of the sidewall. Specifically, each attachment point is positioned on an intermediate section of the sidewall. Further, each attachment point is positioned on a different intermediate section of the sidewall and the attachment points are preferably positioned at diametrically opposed locations on the sidewall. Consequently, the indentations are positioned between the two attachment points along the sidewall. In the preferred embodiment of the present invention, each attachment point includes a base, a pivot and a pair of stops. The base is attached to the outer surface of the sidewall. Preferably, the pivot is mounted on the base and extends from the base in a direction away from the sidewall. Each stop is mounted on the base and extends from the base in a direction away from the sidewall with the pivot positioned between the stops.

In the preferred embodiment, the handle is elongated and substantially planar, and is formed with two ends. One end of the handle is attached to the first attachment point of the container and the other end of the handle is attached to the second attachment point of the container. Each end of the handle is formed with a hole to receive the pivot at the attachment point. For purposes of the present invention, the pivot can be inserted into the hole of the handle and secured by any method known in the pertinent art. Once the pivot is inserted into the hole and secured, the handle remains free to rotate about the pivot. In this configuration, the rotational travel distance of the handle about the pivot is limited by the stops. In one embodiment of the present invention, the handle is free to rotate until the handle is positioned adjacent to the sidewall. Additionally, an elastomeric grip can be positioned on the handle between the two ends to facilitate easy lifting and handling of the infant carrier. A shoulder strap may be attached to the container to facilitate hands-free carrying of the infant carrier.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
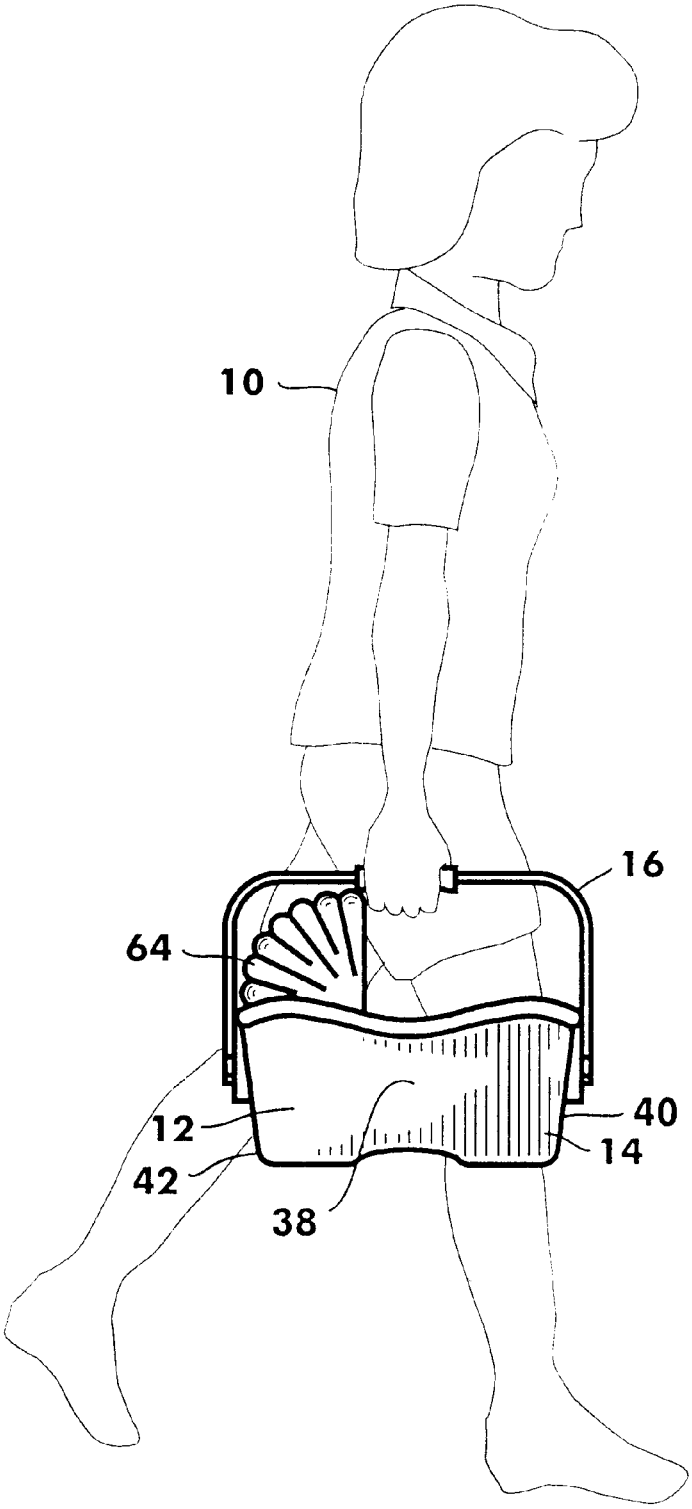
FIG. 1 is a side elevation view of a person carrying an infant carrier in accordance with the present invention.
Figure 2:
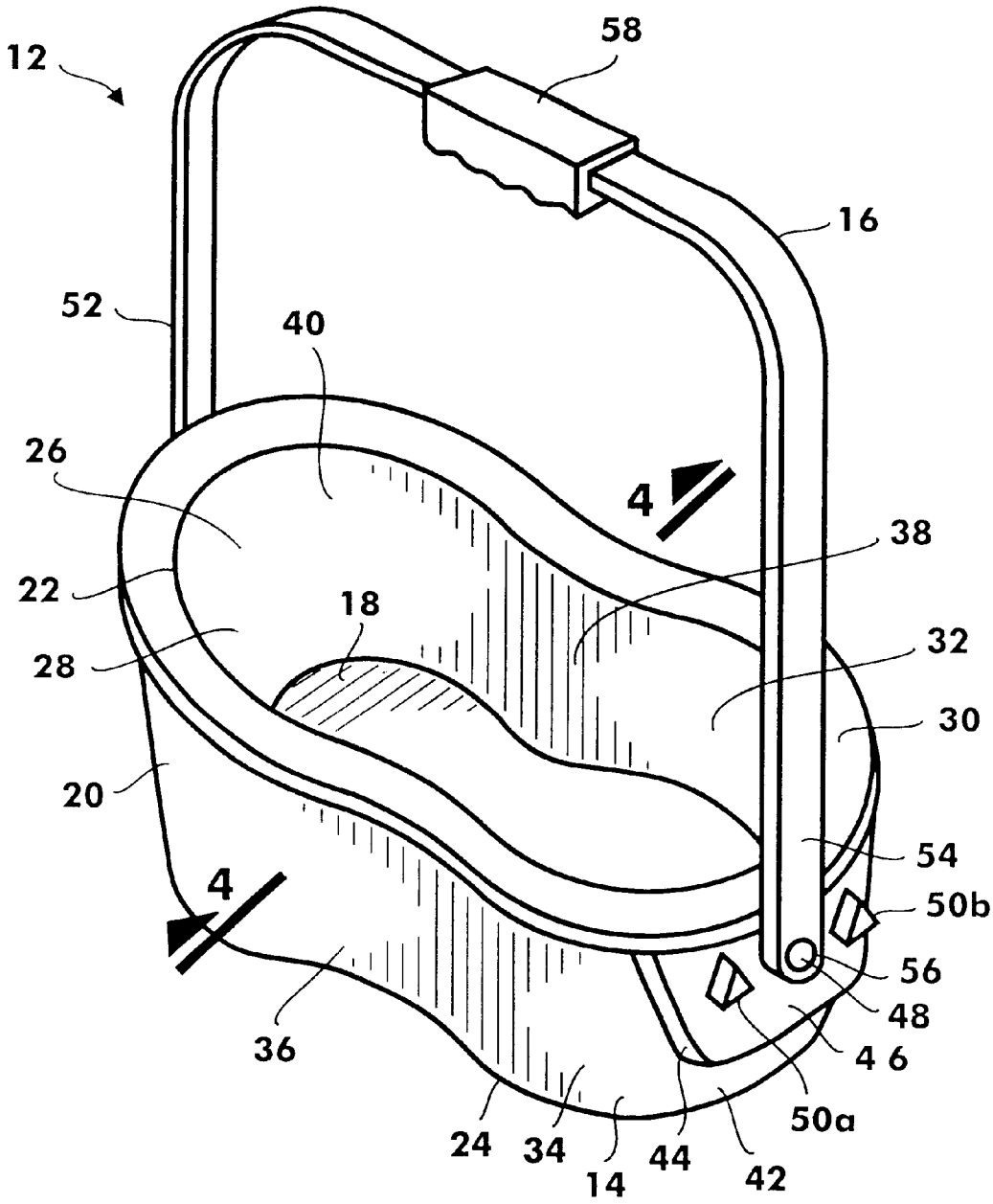
FIG. 2 is a perspective view of an infant carrier in accordance with the present invention.

Referring initially to FIG. 1, a person 10 is shown holding an infant carrier 12 in accordance with the present invention. As shown, it will be seen that the device 12 includes a container 14 and a handle 16. As best seen in FIG. 2, the container 14 includes a bottom wall 18 and an enclosing sidewall 20. The enclosing sidewall 20 is formed with a first edge 22 and a second edge 24. For the present invention, the second edge 24 of the enclosing sidewall 20 is attached to the bottom wall 18 to surround and establish a compartment 26. In this configuration, the first edge 22 surrounds an opening 28 for the compartment 26. In the preferred embodiment, the first edge 22 is formed with a lip 30 that extends away from the opening 28. It is contemplated that the container 14 can be made from molded plastic.

As further shown in FIG. 2, the sidewall 20 has an inner surface 32 that faces toward the compartment 26 and an outer surface 34 that faces away from the compartment 26. Importantly, the sidewall 20 is formed with two indentations 36, 38 that extend into the compartment 26. Each indentation 36, 38 has a concave curvature on the outer surface 34 of the sidewall 20 and a convex curvature on the inner surface 32 of the sidewall 20. In accordance with the present invention, the two indentations 36, 38 can be positioned at diametrically opposed locations on the sidewall 20. As shown in FIG. 2, the sidewall 20 is also formed with two intermediate sections 40, 42. FIG. 2 shows that indentation 36 is positioned between intermediate section 40 and intermediate section 42. Similarly, indentation 38 is positioned between intermediate section 40 and intermediate section 42. It can be seen from FIG. 2 that each intermediate section 40, 42 of sidewall 20 has a convex curvature on the outer surface 34 of the sidewall 20.

For the present invention, the container 14 is further formed with two attachment points 44. Each attachment point 44 is positioned on the outer surface 34 of the sidewall 20. Specifically, each attachment point 44 is positioned on an intermediate section 40, 42 of the sidewall 20. Consequently, the indentations 36, 38 are positioned between the two attachment points 44 along the sidewall 20. As shown in FIG. 2, each attachment point 44 includes a base 46, a pivot 48 and a pair of stops 50*a, b*. It is contemplated for the present invention that the base 46, pivot 48 and stops 50*a, b* are made of a molded plastic, and may be bonded to the container 14 or integrally molded with the container 14. For the present invention, the base 46 is attached to the outer surface 34 of the sidewall 20. The pivot 48 is mounted on the base 46 and extends from the base 46 in a direction away from the sidewall 20. Similarly, the stops 50*a, b* are mounted on the base 46 and extend from the base 46 in a direction away from the sidewall 20. As shown, the pivot 48 is positioned between the stops 50*a, b*.

Figure 3:
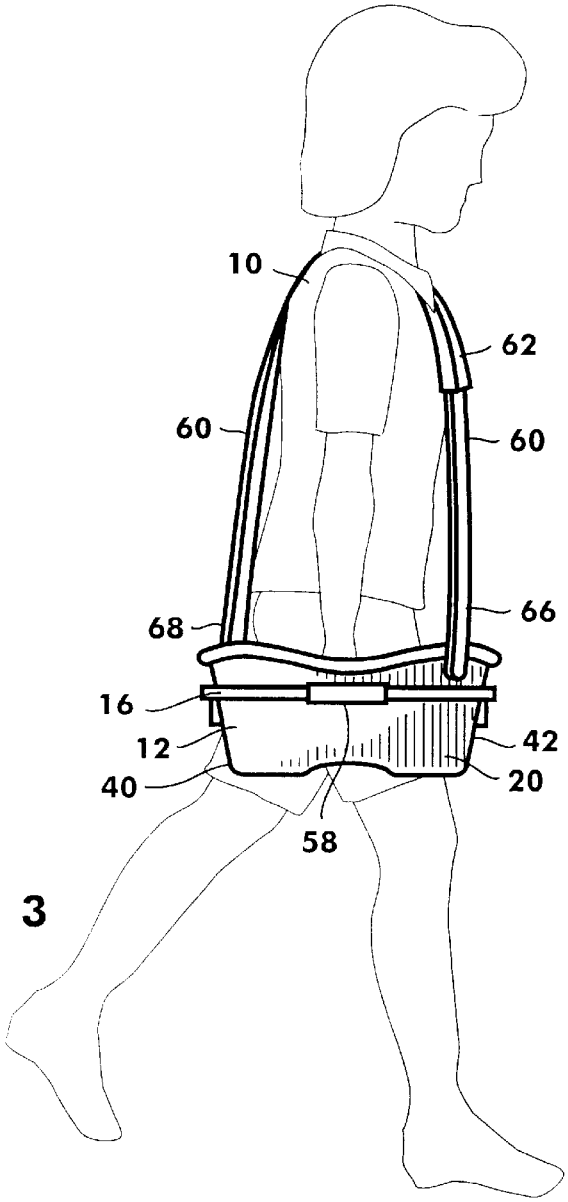
FIG. 3 is a side elevation view of a person carrying an infant carrier having a shoulder strap in accordance with the present invention.
Figure 4A:
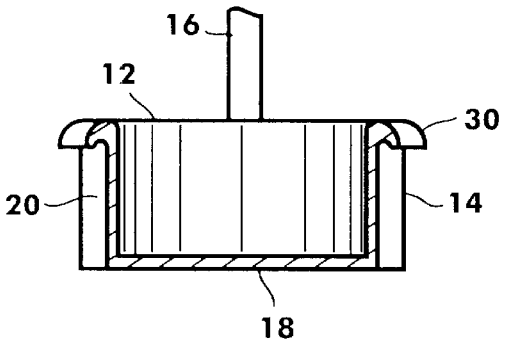
FIG. 4A is cross section of an infant carrier in accordance with the present invention as seen along line 4—4 in FIG. 2 showing an embodiment wherein the bottom of the carrier is substantially flat.
Figure 4B:
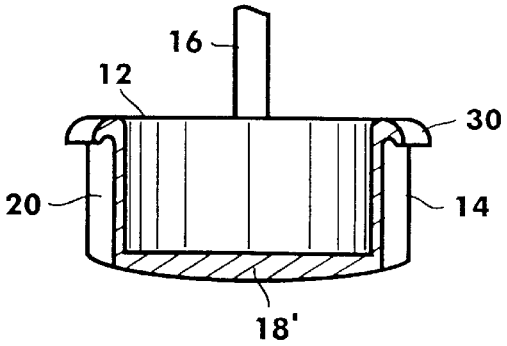
FIG. 4B is cross section of an infant carrier as in FIG. 4A showing an embodiment wherein the bottom the of the carrier is curved.

The handle 16 is preferably elongated and substantially planar and is formed with two ends 52, 54. Each end 52, 54 of the handle 16 is attached to an attachment point 44 of the container 14. Each end 52, 54 of the handle 16 is formed with a hole 56 to receive the pivot 48 at the attachment point 44. The pivot 48 can be inserted into the hole 56 of the handle 16 and secured by a cotter pin (not shown) or any method known in the pertinent art. Once the pivot 48 is inserted in the hole 56 and secured, the handle 16 remains free to rotate about the pivot 48. The rotational travel distance of the handle 16 about the pivot 48 is limited by the stops 50*a, b*. An elastomeric grip 58 can be positioned on the handle 16 between the ends 52, 54 to facilitate easy handling of the infant carrier 12. As shown in FIG. 3, in one embodiment of the present invention, the handle 16 is allowed to rotate about the pivot 48 until the handle 16 is adjacent the sidewall 20. Further, a shoulder strap 60 can be provided to facilitate hands-free carrying of the infant carrier 12. As shown, in the preferred embodiment of the present invention, each end 66, 68 is attached to an intermediate section 40, 42 of the container 14. The shoulder strap 60 may include padding 62. As shown in FIG. 1, the infant carrier 12 may include a shade 64 to prevent excessive sunlight from reaching the infant. FIG. 4A shows that in one embodiment of the present invention, the bottom 18 can be substantially flat. In an alternative embodiment, shown in FIG. 4B, the bottom 18' can be curved to allow the infant carrier 12 to rock.

While the infant carrier as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A device for ergonomically carrying an infant by a person, said device comprising:

a bottom wall having a peripheral edge;

an enclosing sidewall having a first edge and a second edge with said second edge of said sidewall attached to said peripheral edge of said bottom wall to establish a compartment therebetween with said sidewall surrounding said compartment, said sidewall being formed with a first concave indentation extending into said compartment and a second concave indentation extending into said compartment, said first and second concave indentations being positioned at substantially diametrically opposed locations on said sidewall; and a handle formed with a first end and a second end, said first end attached to said sidewall at a first attachment point and said second end attached to said sidewall at a second attachment point, said first and second attachment points positioned at substantially diametrically opposed locations on said sidewall with said first concave indentation positioned substantially midway between said first attachment point and said second attachment point.

2. A device as recited in claim 1 wherein said bottom wall is substantially flat.

3. A device as recited in claim 1 wherein said first edge of said sidewall has a first peripheral length and said second edge of said sidewall has a second peripheral length, and wherein said first peripheral length is greater than said second peripheral length to taper said sidewall outwardly from said bottom wall to said opening.

4. A device as recited in claim 1 wherein said first edge of said sidewall is formed with a lip extending away from said compartment.

5. A device as recited in claim 1 wherein each said end of said handle is formed with a hole and said first and second attachment points on said sidewall are each formed with a pivot for in sertion into a said hole to allow said handle to rotate about said attachment points.

6. A device as recited in claim 5 further comprising a means for limiting the handle rotational travel about said pivot point.

7. A device for ergonomically carrying an article by a person, said device comprising:

a bottom wall formed with a peripheral edge having a bottom edge peripheral length;

an enclosing sidewall, said enclosing sidewall attached to said bottom wall to establish and surround a compartment, said sidewall having a first edge surrounding an opening for said compartment and being formed with at least one indented section extending into said compartment, said first edge of said sidewall having a first edge peripheral length wherein said first edge peripheral length is greater than said bottom edge peripheral length to taper said sidewall outwardly from said bottom wall to said opening; and a shoulder strap formed with a first end and a second end, said first end attached to said sidewall at a first attachment point and said second end attached to said sidewall at a second attachment point, with at least one said indented section positioned between said first and second attachment points.

8. A device as recited in claim 7 wherein said sidewall is formed with two indented sections extending into said compartment.

9. A device as recited in claim 7 wherein said bottom wall is substantially flat.

10. A device as recited in claim 7 wherein said first edge of said sidewall is formed with a lip extending away from said compartment.

11. A device as recited in claim 7 wherein said shoulder strap is a padded strap.

12. A device as recited in claim 7 further comprising a handle attached to said sidewall.

13. A device as recited in claim 7 wherein said bottom wall is curved.

14. A device as recited in claim 12 wherein said handle is substantially planar.

15. A method for manufacturing an infant carrier comprising:

forming a container having an enclosing sidewall and a bottom, said enclosing sidewall attached to said bottom to surround and establish a compartment, said sidewall formed with an indentation extending into said compartment, said sidewall having two pivots, said pivots extending from said sidewall, said indentation positioned on said sidewall between said pivots;

forming a handle having two ends, each said end formed with a hole; and mounting said handle on said container with each said pivot extending into each said hole of said handle.

16. A method as recited in claim 15 further comprising the step of:

mounting a grip on said handle.

17. A method as recited in claim 15 further comprising the step of:

mounting a shade on said container.

18. A method as recited in claim 15 further comprising the step of:

attaching a shoulder strap to said container.

* * * * *